United States Patent [19]

McCready et al.

[11] Patent Number: 4,915,808

[45] Date of Patent: Apr. 10, 1990

[54] ANODE AND CAPSULE ASSEMBLY FOR AUTOMOTIVE CATHODIC PROTECTION

[75] Inventors: David F. McCready, P.O. Box 651, Altoona, Pa. 16603; Kenneth M. Imler, Altoona, Pa.

[73] Assignee: David F. McCready, Altoona, Pa.

[21] Appl. No.: 203,920

[22] Filed: Jun. 8, 1988

[51] Int. Cl.[4] ..... C23F 13/00

[52] U.S. Cl. ..... 204/196; 204/147; 204/280; 204/291; 204/294; 204/286; 439/589; 439/604; 439/606; 439/658; 439/751

[58] Field of Search ..... 204/147, 196, 280, 291, 204/294, 148, 197, 286, 297 MT; 439/588, 589, 604, 606, 658, 718, 751, 908

[56] References Cited

U.S. PATENT DOCUMENTS

| | | | |
|---|---|---|---|
| 464,735 | 3/1987 | McCready | 204/294 |
| 2,776,940 | 1/1957 | Oliver | 204/196 |
| 2,776,941 | 1/1957 | Wagner | 204/196 |
| 4,096,051 | 6/1978 | Annis, Jr. et al. | 204/280 |
| 4,226,694 | 10/1980 | Baboian et al. | 204/147 |
| 4,515,669 | 5/1985 | Dimond et al. | 204/291 |

*Primary Examiner*—John F. Niebling
*Assistant Examiner*—Kathryn Gorgos
*Attorney, Agent, or Firm*—James Creighton Wray

[57] ABSTRACT

A square blocked anode with first and second opposite flat faces and rectangular sidewalls joining the flat faces has a diagonal hole formed between one sidewall and a second face of the anode. Insulation is stripped from a distal end of a multiple strand insulated wire lead and the stripped end is inserted through the sidewall into the diagonal opening. Wire strands which emerge from the opening in the second surface of the anode are spread around the opening and solder may be applied to the spread strands. The square anode is fitted within a capsule having a square body with inner walls similar to the anode and slightly larger than corresponding surfaces of the anode. The insulated wire lead which emerges from the diagonal opening in a sidewall engages an inner surface of the capsule and an opposite sidewall of the anode engages an opposite inner surface of the capsule in friction fit, holding the anode in the capsule after the anode with the emerging wire lead are pressed in the capsule. The wire lead extends across the second surface of the anode within the capsule and emerges through an opening in the opposite sidewall of the capsule. A square flange extends around the open end of the capsule. An adhesive is spread over the surface of the flange and the first surface of the anode which is centered within the flange surface.

14 Claims, 1 Drawing Sheet

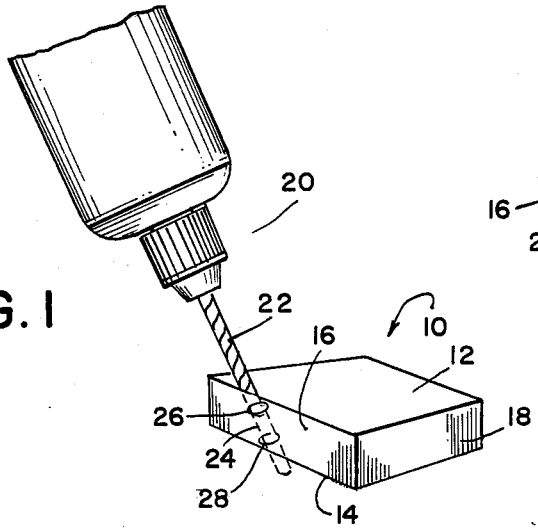
FIG. 1
FIG. 2
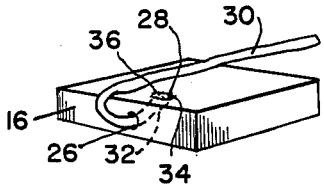
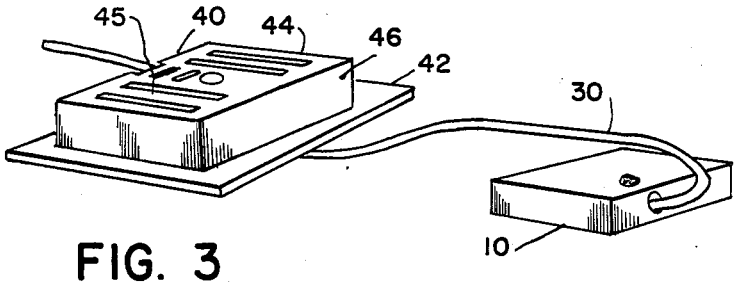
FIG. 3
FIG. 5
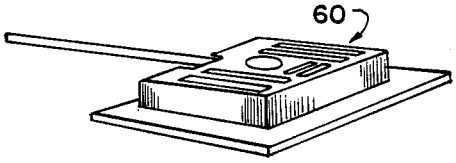
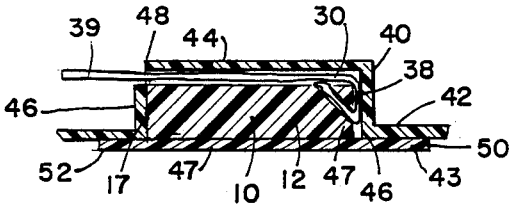
FIG. 4

ANODE AND CAPSULE ASSEMBLY FOR AUTOMOTIVE CATHODIC PROTECTION

BACKGROUND OF THE INVENTION

In an automotive cathodic protection system, composite hydrophilic conductive anodes are attached to painted surfaces of automotive bodies with adhesive coatings which may be epoxies or double sided tapes or other suitable forms of adhesive. The anodes are surrounded on surfaces away from the painted body by a flanged capsule which is also adhered to the body by the same adhesives. A wire lead is attached to the anode and extends from the anode and out through an opening in a capsule to an electronic control. Because of the composition of the anode, it is difficult to attach the wire lead directly to the anode. In the past, the anode has been drilled and countersunk and has been physically connected to the lead and to the capsule with a bolt which extends through the anode connector on the lead and the capsule and a nut. The bolt and nut connectors and preparations to receive the connectors require additional steps and expense which the present invention seeks to avoid.

SUMMARY OF THE INVENTION

The present invention solves the problems inherent in previous connections between lead anodes and capsules in a fast, convenient, and secure manner.

A square blocked anode with first and second opposite flat faces and rectangular sidewalls joining the flat faces has a diagonal hole formed between one sidewall and a second face of the anode. Insulation is stripped from a distal end of a multiple strand insulated wire lead, and the stripped end is inserted through the sidewall into the diagonal opening. Wire stands which emerge from the opening in the second surface of the anode are spread around the opening, and solder is applied to the spread strands. Hardening of the solder prevents the return of the strands through the opening and anchors the lead to the anode. The square anode is fitted within a capsule having a square body with inner walls similar to the anode and slightly larger than corresponding surfaces of the anode. The insulated wire lead which emerges from the diagonal opening in a sidewall engages an inner surface of the capsule and an opposite sidewall of the anode engages an opposite inner surface of the capsule in friction fit, holding the anode in the capsule after the anode with the emerging wire lead are pressed in the capsule. The wire lead extends across the second surface of the anode within the capsule and emerges through an opening in the opposite sidewall of the capsule. A square flange extends around the open end of the capsule. An adhesive is spread over the surface of the flange and the first surface of the anode which is centered within the flange surface. The capsule flange and the first surface of the anode are attached to a painted surface of the automobile with the adhesive.

An encapsulated anode for an automotive cathodic protection system comprises a generally rectangular block anode made of a compressed and sintered absorbent carbon and silica material The anode has a first face for juxtaposing to a painted sheet metal surface and has a second generally parallel face spaced therefrom; sidewalls extend between the faces. A hole extends diagonally through a sidewall and through the second face near that sidewall. A multistrand insulated wire lead has a distal end stripped of insulation and extended through the diagonal hole and outward beyond the second face. Strands of the wire lead are bent along the face. Solder disposed on the strands fuses the bent strands into a solid mass and prevents removal of the wire from the opening. A capsule surrounds the block anode and covers the second face and sidewalls and the diagonal opening. The capsule has an opening for passing the wire lead, and the wire lead extends outward through the opening in the capsule.

The capsule opening is opposite the diagonal hole when the anode is placed within the capsule. The lead extends from the diagonal hole along the sidewall in which the hole is located and across the second face of the anode and out through the capsule opening.

The anode and capsule and lead are press fit together, whereby the lead and anode fit tightly within the capsule and hold the anode and capsule assembled.

An adhesive coating extends across the first face of the anode and adjacent portions of the capsule and a release sheet mounted on the adhesive coating, whereby the release sheet is removed for using the adhesive coating for attaching the anode and capsule to a painted sheet metal surface to be cathodically protected.

Preferably the capsule has flanges extending outward therefrom in a generally planar configuration with first faces of the flanges in alignment with the first face of the anode and wherein an adhesive coating uniformly coats the first flange faces and the first anode face for attachment to the painted sheet metal surface.

A preferred capsule has a generally square body extending outward from the flanges. Inner surfaces of the capsule sidewalls tightly engage the wire lead extending from the diagonal hole in the anode and an opposite sidewall of the anode, thereby holding the capsule and anode assembled.

The preferred method of assembling an anode, an insulated wire lead, and a capsule cover for the anode comprises forming a block anode having a first mounting surface, a second opposite surface and having sidewalls interconnecting the first and second surfaces, forming a diagonal opening through a sidewall and the second surface, removing insulation from a distal end of a lead and exposing wires therein, inserting the distal end through the opening in the sidewall and out through the opening in the second surface, bending exposed wires across a portion of the second surface near the opening and attaching solder to the bent wires thereby preventing regress of the distal end through the opening and covering the anode, the opening, and a portion of the wire attached to the opening with a capsule.

The preferred method further comprises press fitting the wire and the anode within the capsule and engaging an inner sidewall of a capsule with a portion of the wire emerging from the diagonal opening in the sidewall of the anode and engaging an opposite inner portion of the capsule with an opposite sidewall of the anode.

These and other and further objects and features of the invention are apparent in the disclosure which includes the above and ongoing written specification and claims and the drawings.

BRIEF DESCRIPTION OF THE DRAWINGS

FIG. 1 schematically shows the drilling of a diagonal hole which extends through a sidewall and one face of an anode.

FIG. 2 shows the anode of FIG. 1 which has been inverted A stripped distal end of a wire lead has been inserted in the drilled opening and solder has solidified wires bent over the surface of the anode.

FIG. 3 shows the insertion of the anode with the attached lead in the capsule.

FIG. 4 shows the interference fit between the anode, lead wire, and capsule.

FIG. 5 shows the assembled fuse of the anode and capsule.

DETAILED DESCRIPTION OF THE DRAWINGS

Referring to FIG. 1, in a preferred form, the block anode 10 is formed of a hydrophilic conductive composite material which increases conductivity in relation to increased moisure content. Anode 10 has generally square first and second faces 12 and 14 and connecting sidewalls 16 and 18, of which two are shown. A drill 20 with a suitably sized bit 22 drills a diagonal hole 24 preferably at a 45 degree angle with an opening 26 in sidewall and an opening 28 in face 14.

As shown in FIG. 2, an insulated multistrand copper wire 30 has a distal end 32 from which insulation has been stripped. The bare end of the wire is inserted through opening 26 in sidewall 16. The bare strands 34 extend out of opening 28. The ends of the wire strands are bent along the face. Finally a drip of solder 36 is added to the bent strands. When the solder hardens it is impossible to pull the wire from the anode.

Finally the assembled anode 10 is inserted in a capsule 40 as shown in FIG. 3.

Capsule 40 is formed with a generally square shape and an outward flange 42 and an outer wall 44 and interconnecting sidewalls 46. Openings 45 are formed in the outer wall 44 to permit the entry of moisture and to ensure that anode 10 is maintained at ambient conditions. As shown in FIG. 4 inner surfaces 47 of the sidewalls 46 tightly grip one sidewall 17 of anode 10 and the portion 38 of insulated wire 30 which emerges from the opening 26 in the sidewall 16. Anode 10 and the insulated wire thus are held assembled in the capsule by a friction fit after the anode and wire are pressed into the capsule. The remote end 39 of the insulated wire extends through an opening 48 in one capsule sidewall 46. As shown in FIG. 4, a coating of adhesive 50 is applied over the other surfaces 43 and flanges 42 and other surface 12 of anode 10. The adhesive 50 may be covered by a release sheet 52 which is removed before the capsule and anode are adhered to a painted surface of an automobile body.

The assembled capsule anode and lead are generally indicated by the numeral 60 in FIG. 5.

While the invention has been described by reference to a specific embodiment, modifications and variations of the invention may be constructed without departing from the scope of the invention which is defined in the following claims.

I claim:

1. An encapsulated anode for an automotive cathodic protection system comprising a generally rectangular block anode made of a compressed absorbent carbon and silica material, the anode having a first face for juxtaposing to a painted sheet metal surface and having a second generally parallel face spaced therefrom, and having sidewalls extending between the faces, a hole extending diagonally through a sidewall and through the second face near that sidewall, and a multistrand insulated wire lead having a distal end stripped of insulation and extending through the diagonal hole in the side wall and outward through the hole in the second face, strands of the wire lead being bent along the second face and securing the strands extending outward through the hole in the second face thereby preventing removal of the wire lead from the hole in the second face, and a capsule surrounding the block anode and covering the second face and sidewalls and the diagonal hole, the capsule having an opening for passing the wire lead, and the wire lead extending outward through the opening in the capsule.

2. The apparatus of of claim 1 wherein the capsule opening is opposite the diagonal hole in the sidewall of the anode when the anode is placed within the capsule, and therein the lead extends from the diagonalhole, along the sidewall in which the hole is located, across the second face of the anode and out through the capsule opening.

3. The apparatus of claim 2 wherein the anode and capsule and lead are press fit together, whereby the lead and anode are held assembled in the capsule by a friction fit.

4. The apparatus of claim 3 further comprising an adhesive coating extending across the first face of the anode and adjacent portions of the capsule and a release sheet mounted on the adhesive coating, whereby the release sheet is removed for using the adhesive coating, whereby the release sheet is removed for using the adhesive coating for attaching the anode and capsule to a painted sheet metal surface to be cathodically protected.

5. The apparatus of claim 1 wherein the capsule has flanges extending outward therefrom in a generally planar configuration with first faces of the flanges in alignment with the first face of the anode and wherein an adhesive coating uniformly coats the first flange faces and the first anode face for attachment to the painted sheet metal surface.

6. The apparatus of claim 1 wherein the capsule has a generally square body extending outward from the flanges and wherein inner surfaces of thecapsule sidewalls tightly engage sidewalls of the anode and the wire lead extending from the diagonal hole in the sidewall of the anode, thereby holding the capsule and anode assembled by a friction fit.

7. The method of assembling an anode, an insulated wire lead, and a capsule cover for the anode, comprising:

forming a block anode having a first mounting surface, a second opposite surface and having sidewalls interconnecting the first and second surfaces, forming a diagonal opening through a sidewall and the second surface, removing insulation from a distal end of a lead and inserting the distal end through the opening in the sidewall of the anode and out through the opening in the second surface, bending wire of the distal end of the lead across a portion of the second surface near the opening in the second surface and securing the bent wire thereby preventing regress of the distal end of the lead through the opening in the second surface and covering the anode, the opening in the second surface, and the secured portion of the bent wire with a capsule.

8. The method of claim 7 further comprising press fitting the wire and the anode within the capsule and engaging an inner sidewall of a capsule with a portion of the wire emerging from the diagonal opening in the sidewall of the anode and engaging an opposite inner portion of the capsule with an opposite sidewall of the anode.

9. An encapsulated anode for an automotive cathodic protection system, comprising:

a generally rectangular block anode made of a decompressed absorbent carbon and silica material, the anode having a first face and having a second generally parallel face spaced therefrom, and having sidewalls extending between the faces, and a multistrand insulated wire lead having a distal end stripped of insulation, uninsulated strands of the wire lead being bent along the second face and a conductor disposed on the strands thereby forming the bent strands into a solid mass and preventing removal of the wire lead from the second face, and a rectangular capsule surrounding the block anode and covering the second face and sidewalls and provides additional support in preventing removal of the wire lead from the second face, the capsule having a first opening for passing the wire lead, and the wire lead extending outward from the second face through the first opening in the capsule, wherein further the capsule has additional openings for permitting the entry of moisture and for ensuring that the anode is maintained at ambient conditions.

10. The apparatus of claim 9 wherein the anode and capsule and lead are fixed together, whereby the lead and anode fit tightly and hold the anode and capsule assembled.

11. The apparatus of claim 10, further comprising an adhesive coating extending across adjacent portions of the capsule and a release sheet mounted on the adhesive coating, whereby the release sheet is removed for using the adhesive coating for attaching the anode and capsule to a painted sheet metal surface to be cathodically protected.

12. The apparatus of claim 9 wherein the capsule has a generally planar configuration with a first face in alignment with the first face of the anode and wherein an adhesive coating uniformly coats at least one of first faces for attachment to a painted sheet metal surface.

13. The apparatus of claim 12, wherein the capsule has a generally square body extending outward from the surface and wherein inner surfaces of the capsule surround the anode when the capsule and anode are assembled.

14. The method of assembling an anode, an insulated wire lead, and a capsule and a cover for the anode comprising forming a block anode having a first mounting face, a second opposite face, and having sidewalls interconnecting the first and second faces, removing insulation from a distal end of a lead and inserting the distal end through an opening in the capsule, attaching the wire of the second face, thereby preventing regress of the distal end of the wire through the opening in the capsule; and covering the anode and a portion of the wire attached to the second face with the rectangular capsule cover.

* * * * *